US005498808A

United States Patent [19]

Smith

[11] Patent Number: 5,498,808

[45] Date of Patent: Mar. 12, 1996

[54] FLUORESCENT PETROLEUM MARKERS

[75] Inventor: Michael J. Smith, Newtown, Pa.

[73] Assignee: United Color Manufacturing, Inc., Newtown, Pa.

[21] Appl. No.: 375,310

[22] Filed: Jan. 20, 1995

[51] Int. Cl.[6] ..... C10L 1/10; C07C 7/20

[52] U.S. Cl. ..... 585/3; 585/4; 585/5; 208/15; 208/17; 44/403

[58] Field of Search ..... 585/3, 4, 5; 208/15, 208/17; 44/403

[56] References Cited

U.S. PATENT DOCUMENTS

| | | | |
|---|---|---|---|
| 2,046,365 | 7/1936 | Cassidy et al. | 44/9 |
| 3,883,568 | 5/1975 | Turner et al. | 260/383 |
| 4,209,302 | 6/1980 | Orelup | 44/59 |
| 4,514,503 | 4/1985 | Orelup | 436/60 |
| 4,735,631 | 4/1988 | Orelup | 44/59 |
| 4,764,290 | 8/1988 | Currey | 252/11 |
| 4,764,474 | 8/1988 | Orelup | 436/111 |
| 4,904,765 | 2/1990 | Derber et al. | 534/573 |
| 4,918,020 | 4/1990 | Nowak | 436/56 |
| 5,145,573 | 9/1992 | Riedel et al. | 208/14 |
| 5,156,653 | 10/1992 | Friswell et al. | 44/328 |
| 5,205,840 | 4/1993 | Friswell et al. | 44/428 |

*Primary Examiner*—Asok Pal
*Assistant Examiner*—Bekir L. Yildirim
*Attorney, Agent, or Firm*—Howrey & Simon

[57] ABSTRACT

Markers for petroleum products which can be detected upon addition of a developing reagent which provokes the marker to fluorescence.

32 Claims, No Drawings

FLUORESCENT PETROLEUM MARKERS

BACKGROUND OF THE INVENTION

The present invention relates to colorless or near colorless compounds useful for marking or tagging petroleum fuels. It also pertains to a reagent useful in developing color and fluorescence of base-extractable markers.

A marker is a substance which can be used to tag petroleum products for subsequent detection. The marker is dissolved in a liquid to be identified, then subsequently detected by performing a simple physical or chemical test on the tagged liquid. Markers are sometimes used by government to ensure that the appropriate tax has been paid on particular grades of fuel. Oil companies also mark their products to help identify those who have diluted or altered their products. These companies often go to great expense to make sure their branded petroleum products meet certain specifications regarding volatility and octane number, for example, as well as to provide their petroleum products with effective additive packages containing detergents and other components Consumers rely upon the product names and quality designations to assure that the product being purchased is the quality desired.

It is possible for gasoline dealers to increase profits by selling an inferior product at the price consumers are willing to pay for a high quality branded or designated product. Higher profits can also be made simply by diluting the branded product with an inferior product. Policing dealers who substitute one product for another or blend branded products with inferior products is difficult in the case of gasoline because the blended products will qualitatively display the presence of each component in the branded products. The key ingredients of the branded products are generally present in such low levels that quantitative analysis to detect dilution with an inferior product is very difficult, time consuming and expensive.

Marker systems for fuels and other petroleum products have been suggested but various drawbacks have existed which have hindered their effectiveness. Many, for instance, lose their color over time, making them too difficult to detect after storage. In addition, reagents used to develop the color of markers often are difficult to handle or present disposal problems. Furthermore, some marking agents partition into water. This causes the markers to loose effectiveness when storage occurs in tanks that contain some water.

The present invention provides markers which are invisible in liquid petroleum products but that provide a distinctive fluorescence and/or color when extracted from the petroleum product with an appropriate developing reagent. The reagents used to develop the fluorescence are themselves easy to handle and dispose of.

SUMMARY OF THE INVENTION

The present invention includes marker compositions and compositions comprising a liquid petroleum product and a detectable level of marker which is a derivative of 2(3H) Furanone in which the number 5 carbon atom is part of a xanthene system:

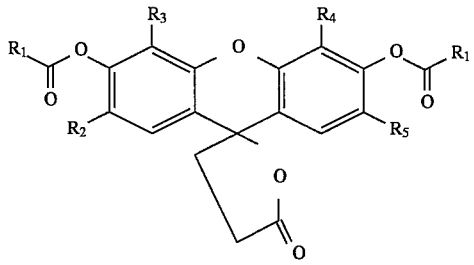

I.

wherein $R_1$ is an alkyl group containing from one to eighteen carbon atoms, or an aryl group. $R_2$, $R_3$, $R_4$, and $R_5$ are hydrogen, chlorine, bromine or a $C_1$–$C_{12}$ alkyl. $R_1$ may be the same or different groups and $R_2$–$R_5$ may be the same or different groups. The alkyl groups may be straight or branched. The carbon atoms 1 and 2 of the (3H) Furanone ring may be saturated or an ethylenic bond may exist between them. The hydrogen atoms attached to these carbon atoms may also be replaced wholly or in part by alkyl groups.

Alternatively, the number 1 and 2 carbon atoms of the 3(H) Furanone ring may form part of a carbocyclic ring system particularly a benzo ring system. Especially preferred are 3,3 bis substituted derivatives of 1(3H) isobenzofuranone where the number 3 carbon atom forms part of a xanthene system.

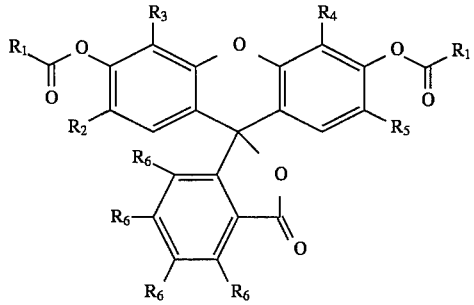

II.

where R1–R5 are the same as already described above and $R_6$ is any combination of hydrogen, bromine or chlorine. Again, the alkyl group may be straight or branched. When $R_1$–$R_5$ is an alkyl group it will frequently be $C_1$–$C_4$.

The present invention also includes a method of marking a liquid petroleum product comprising adding to the liquid petroleum product a detectable level of a marker selected from the group consisting of:

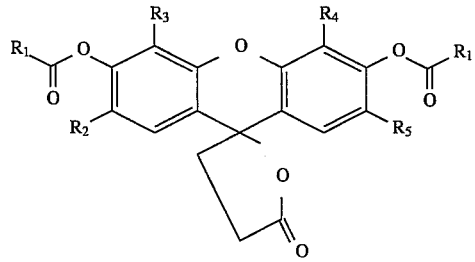

I.

-continued

II.

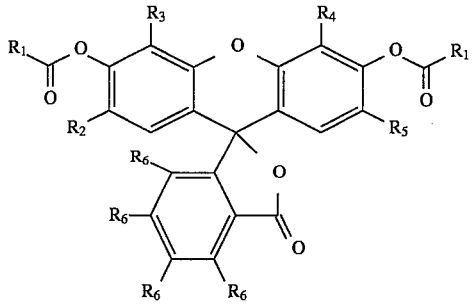

wherein $R_1$ and $R_2$–$R_6$ are the same as described above.

The present invention is also a method of identifying a liquid petroleum product comprising, a) obtaining a sample of liquid petroleum product containing a detectable level of a marker described above, b) and adding a developing reagent to the sample to develop fluorescence.

DETAILED DESCRIPTION OF THE INVENTION

Compositions of the present invention contain organic esters of fluorescent dyestuffs of the hydroxyphthalein subclass of Xanthene dyes, as classified in the "Colour Index", third edition, 1975. These are more commonly referred to as organic esters of fluoroscein ($C_{20}H_{12}O_5$). Especially preferred are the esters of 3'6' dihydroxy Spiro [isobenzofuran-1(3H) ,9'-(9H) xanthene]-3-one, commonly called Fluoroscein, which is symbolized as:

II.

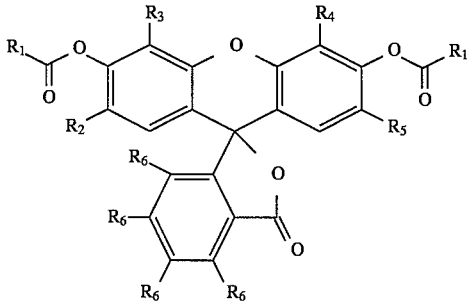

where $R_1$ is an alkyl of 1–18 carbon atoms or an aryl group. Also preferred are esters of Fluoroscein where the aromatic ring hydrogen atoms 1', 2', 4', 5', 7' and 8' and 4,5,6,7 are replaced by non-ionizing substituents such as alkyl groups, hydrogen, chlorine or bromine. In particular, the invention includes the above compounds when $R_2$, $R_3$, $R_4$, and $R_5$ are hydrogen, chlorine, or bromine or $C_1$–$C_{12}$ alkyl and $R_6$ is hydrogen, chlorine or bromine. $R_1$–$R_6$ may be the same or different groups and alkyl groups may be straight or branched. For many applications $R_2$–$R_6$ are preferably H and $R_1$ is preferable $C_1$–$C_4$ alkyl group.

Markers of the present invention also include chemicals of the following formula:

I.

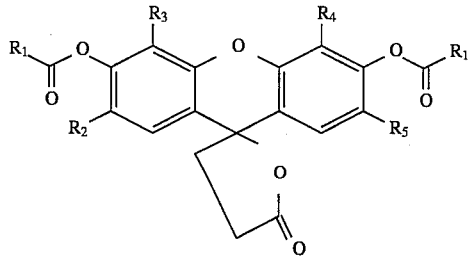

wherein $R_1$–$R_5$ are as described above.

Fluoroscein itself has been used in the form of its water soluble salts as a marking or tagging substance for both artificial and natural water courses, for examples, so that the course of streams, rivers and sewer lines can be traced. It has also been used as a diagnostic marker in the human vascular system. It is usually considered a tinctorially weak yellow dye and is most valued for its ease of detection, even at very considerable dilution exhibiting strong fluorescence., This fluorescence is observable under natural or appropriate artificial light sources, especially a long-wave ultraviolet, or "black light" lamp. A spectro-fluorimeter can accurately quantify fluoroscein concentrations down to one part per billion ($10^{-9}$ grams per milliliter). Fluoroscein is also known for its low toxicity and ready biodegradability.

Fluoroscein is not itself suitable as a marker for petroleum fuels, however, because it partitions readily between water and petroleum. When fuel containing Fluorscein is in contact with water, as often happens in fuel storage tanks, the compound partitions between the two phases and is rendered useless as a quantitative petroleum marker.

In accordance with the present invention, by converting Fluoroscein to an organic diester any tendency to water bleed (partition) can be minimized or eliminated, by use of an esterifying agent. The diester may be derived from an organic acid, its anhydride or halide containing from one to eighteen carbon atoms. Another advantage of esterification is that the weak yellow color of Fluoroscein itself is diminished to a negligible extent in technical quality products, and can be eliminated entirely in purified material. This renders the presence of the marker substance in the marked fuel invisible to the human eye. The esterification therefore prevents the marker from obscuring coloring agents that may have been added to comply with regulatory requirements or for other reasons.

The ester markers of the present invention may be added to any liquid petroleum products such as fuels, lube oils and greases. Examples of liquid petroleum products of the present invention are gasoline, diesel fuel, fuel oil, Kerosene and lamp oil. The ester markers, when developed, are detectable visually over a wide range of concentrations but preferably are present at a level of at least about 0.5 ppm or 5 ppm and most preferably at a level of about 0.5 to about 100 ppm.

Because the markers are essentially colorless in petroleum products, their presence is detected by reacting them with a developer or developing reagent. For use in the present invention, the developing reagent preferably contains a strong base such as an alkali metal hydroxide, or more preferably a quaternary ammonium hydroxide. The pH of the developing reagent is about 10 to about 14 and preferably about 11 to about 13. The base is believed to hydrolyse the esters and prompt formation of a highly fluorescent dianion, which also may be variously colored. The fluorescence readily permits visual detection. Providing that only a qualitative indication of the presence of the marker is required, the now-fluorescent "developed" fuel may be returned to its source. In this way, the developing reagent and marker are burned or used up with the product so that no potentially hazardous waste from, say, a roadside test, accumulates for disposal.

In the event that the fluorescence of the developed marker is obscured by other coloring agents in the petroleum product, the fluorescent dianion may be rendered visible by extraction from the developed fuel into an extraction medium. This may be accomplished by addition of water alone as an extraction medium to the sample, but use of mixtures of water and a phase separation enhancer such as aliphatic alcohols, glycols, or glycol ethers are preferred. Use of a phase separation enhancer promotes an easier separation of the aqueous and organic phases. Additionally, other substances, for example pH buffer salts, may be present in the extractant phase to stabilize the fluorescent anion. Preferred extraction medium mixtures also contain quaternary ammonium hydroxide compounds to provide a simple method of both developing fluorescence by forming the dianion and a suitable medium into which the developed dianion can immediately extract. Other strong bases, of course, may be used, particularly alkalai metal hydroxides.

The extracted phase may be examined visually for the brilliant yellow to green fluorescence characteristic of the Fluoroscein derived dianion. At extremely low concentrations (about 1 to about 500 parts per billion) the fluorescence may be rendered more readily visible by irradiation of the extracted dye with long-wave ultraviolet light. Alternatively, the extracted marker may be detected and quantified by visible light absorption spectrophotometry or by spectrofluorimetry. A further advantage of the extraction technique is that it affords the opportunity to concentrate the marker from the petroleum fuel, thereby increasing the sensitivity of the test procedures.

The marker compounds of the present invention may be synthesized by any of a number of conventional methods for estrifying phenolic hydroxy groups. These include direct esterification with acids, reaction with acid halides, especially acid chlorides, and most significantly by reaction with acid anhydrides. In general, the preferred technique is to react the hydroxy xanthene with the acylating agent under aqueous or non aqueous conditions as appropriate to the' individual reactants. The esters obtained from the lower aliphatic carboxylic acids are relatively high-melting solids and may be isolated as such. Esters of the higher carboxylic acids tend to be low-melting solids or viscous liquids which may be isolated as solutions in an appropriate solvent.

As previously noted the formula of preferred markers resulting from the esterification reaction is set forth below:

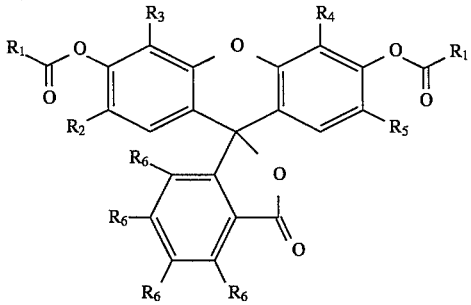

II.

$R_1$ is a $C_1$–$C_{18}$ alkyl group or an aryl group. Preferably, $R_1$ is $C_1$–$C_4$ in either the normal, or branched chain forms. In many petroleum product applications, $R_2$–$R_6$ are preferably all hydrogen. The presence of halogen atoms in the carbocyclic ring systems may provide different shades of visible color and fluorescence after hydrolysis of the ester. Bromine atoms, for instance, tend to impart a redder shade to the product compared with hydrogen atoms.

Esters of the present invention may be produced and used in dry form (usually power, crystals or flakes) or liquid form. Liquid forms are usually preferred for handling reasons. Esters of the present invention may be produced directly and used directly as liquids without addition of solvents. Often, however, it is preferred to combine the marker with a solvent for the marker and which is also itself readily soluble in the petroleum product to be marked. Accordingly, prior to mixing with many petroleum products, the marker may be dissolved, by conventional techniques, in a solvent that has complete compatability with the petroleum products being marked. Suitable solvents for use with liquid petroleum products, for instance, include aromatic hydrocarbons (especially alkyl benzenes, such as xylene, and naphthalenes) aromatic alcohols, especially Benzyl alcohol, and aprotic solvents like formamide, N,N dimethylformamide or 1 methylpyrrollidinone. These solvents may be used singly or advantageously in blends. The aprotic Solvents are particularly useful as a cosolvent combined with an aromatic or aromatic alcohol solvent. For instance, a composition comprised of about 0.5–10% by weight marker, about 70–80% by weight aromatic hydrocarbon solvent and about 10–30% by weight aprotic solvent may be particularly useful as a composition that dissolves readily in many liquid petroleum products and is stable in the product; that is, it remains dissolved in the petroleum product for a commercially significant period of time.

Partricularly when combined with appropriate solvents, therefore esters of the present invention form stable liquid compositions that dissolve readily into petroleum products. The availability of marker compounds as stable, free-flowing liquids makes them much more attractive to the petroleum industry than dry or solid products primarily because liquids are easier to handle. Dry or solid forms of markers, however, could be used.

The following examples serve to illustrate but do not limit the scope of the invention.

EXAMPLE 1

33.2 grams of Fluoroscein is added to a stirred 500 ml reaction flask already containing 200 grams of glacial acetic acid and 25 grams of acetic anhydride. 0.3 grams of concentrated sulfuric acid is then added and the flask is stoppered. The contents of the flask are then heated externally until they start to boil. Boiling is continued under reflux until a sample of the flask contents examined by thin layer chromatography indicates that all of the original Fluoroscein is converted to its diacetate ester.

The contents of the flask are then cooled below the boiling point and added slowly, with good stirring, to 600 mls of Cold water. The mixture is stirred to hydrolyse unreacted acetic anhydride, after which the product is recovered by filtration on a Buchner funnel, it is washed free from acetic acid with distilled water, then dried to constant weight at 105° C. The product is obtained as creamy white crystals in almost quantitative yield. The compound has a melting point of 199°–203° C.

EXAMPLE 2

The above procedure is repeated with 50 grams of 2,7 di-n-hexyl fluoroscein replacing the 33.2 grams of fluoroscein. The final product, 2,7 di-n-hexyl 3.6 diacetoxyfluoroscein, is obtained as a yellowish cream solid.

EXAMPLE 3

The procedure from example one is again repeated with 65 grams of 2,4,5,7 tetrabromofluoroscein replacing the 33.2 grams of fluoroscein. The product, 2,4,5,7 tetrabromo 3,6 diacetoxyfluoroscein, is obtained as a pale yellow powder.

EXAMPLE 4

The procedure from example one is repeated with 79.0 grams of 4,5,6,7 tetrachloro 2,4,5,7 tetrabromofluoroscein replacing the 33.2 grams fluoroscein. The final product, the diacetylester of the starting material, is a pale yellow powder.

EXAMPLE 5

The procedure from example one is repeated except that the 25 grams of acetic anhydride is replaced by 40 grams of butyric anhydride. The esterification procedure is somewhat slower but ultimately an almost quantitative yield of the di-n-butoxy ester of fluoroscein is obtained.

EXAMPLE 6

33.2 grams of fluoroscein, contained in a 500 ml reaction flask, is dissolved in 600 milliliters of cold water by the addition of 16 grams of a 50% solution of sodium hydroxide. 12 grams of anhydrous sodium carbonate is now added to the contents of the flask, followed by 160 mls of xylene solvent. The two-phase system is then stirred at 20-25° during the 60 minute dropwise addition of 40 grams of butyric anhydride. As the esterification of the fluoroscein proceeds, the intense color and fluorescence of the lower aqueous phase is discharged, and the product dissolves in the xylene to form a pale yellow non-fluorescent solution. When all the butyric anhydride has been added, the reaction mixture is heated externally to 50°–55° C. until thin layer chromatography indicates the esterification is complete. The two phases are allowed to separate and the lower aqueous phase, containing a mere trace of unreacted fluoroscein, is removed. To the remaining upper xylene phase is added 50 grams of 1-methylpyrollidone. The contents of the flask are then placed under vacuum and all traces of water, and sufficient xylene, are azeotropically distilled out until the total weight of the reaction mass is 165 grams. This almost colorless solution of the dibutyl ester of fluoroscein is filtered and placed in storage. The solution has good resistance to crystallization even when stored for 3 months at 0° Fahrenheit.

EXAMPLE 7

The procedure of example 6 is repeated except that the n-butyric anhydride is replaced by an equal weight of iso-butyric anhydride. A similar product is obtained except that it has even better resistance to crystallization when stored for prolonged periods at low temperatures.

EXAMPLE 8

The procedure of example 6 is repeated except that 40 gms of butyric anhydride is replaced by 47 gms of pivalic anhydride. The final di (1,1,1 trimethylacetyl) ester of the fluorescein is an off-white solid with essentially the same marker properties as the di-n-butyl ester of Example 6.

EXAMPLE 9

The procedure of example 6 is repeated except that the 33.2 grams of Fluoroscein is replaced by 50.8 grams of 4,5,6,7 tetrachlorofluoroscein. The final product forms a pale yellow solution which is less stable to extended refrigerated storager than the product of Example six.

EXAMPLE 10

20 grams of fluoroscein diacetate prepared as in example one is stirred into 50 grams of Exxon Aromatic® 200 solvent and 30 grams of 1 Methylpyrollidone is added. The mixture is heated to 80° F. until all of the ester has dissolved, the hot solution is filtered and bottled. The solution shows only a slight tendency to crystallize upon prolonged storage at 0° F.

EXAMPLE 11

50 grams of Fluoroscein dibutyrate prepared by the method of example four is dissolved in 50 grams of 1 Methylpyrollidone by gentle heating. The filtered solution has excellent storage stability at 0° F.

EXAMPLE 12

33.2 grams of Fluorescein is added to 150 mls of pyridine to which 36 grams of 2 ethyl hexanoyl chloride is added. The mixture is heated to reflux (125°) and boiled overnight. The reaction mixture was sampled the next morning and analyzed by thin layer chromatography which indicated that formation of the diester was complete. The reaction mixture was then poured into 1 liter of cold water which was then adjusted to pH 3 with hydrochloric acid. The product separated as a brownish oil which was extracted with toluene. The toluene solution was then vacuum stripped to remove all readily volatile material which left 65 grams of a brownish oil readily soluble in xylene to form a light brown solution.

EXAMPLE 13

11 grams of the 2(3H) furanone derivative known as Succinfluorescein prepared by the condensation of one molar equivalent of succinic anhydride with two of resorcinol under dehydrating conditions is mixed with 75 grams of pyridine. To this mixture is added 25 grams of Lauroyl chloride. The mixture is brought to reflux (125°) and boiled overnight until a sample of the reaction mixture analyzed by thin layer chromatography indicates complete esterification of the succinfluorescein. The reaction mixture is cooled to 90° and poured into 1 liter of cold water. The mixture is then acidified to pH 3 with hydrochloric acid. The product which is a brownish oil is extracted with 150 mls toluene. The resulting solution is dried free from extrained water by azotropic distillation after which the remaining toluene is removed by vacuum distillation. The final product is a dark oil readily soluble in xylene to produce a light brown solution.

EXAMPLE 14

The procedure of example (13) is followed except that the 25 grams of Lauroyl chloride is replaced by 35 grams of Stearoyl chloride. The final product is a light brown waxy solid readily soluble in xylene.

EXAMPLE 15

500 milligrams of the solution obtained in example seven is dissolved in toluene and made to 100 mls in a graduated flask. 1.0 ml of this solution is pipetted into 100 mls of premium gasoline (purchased retail), already colored red with 3 parts per million of Unisol Liquid Red B, and contained in a separatory funnel. The gasoline sample contains the equivalent of 10 ppm fluoroscein diacetate as a marker. 5 mls of an aqueous solution containing 15% sodium chloride and sufficient potassium hydroxide to raise its pH to 12.0 is now added to the marked gasoline in the separatory funnel. The two phases are shaken together for two to three minutes, then allowed to separate. The upper gasoline phase retains its light red appearance but the lower aqueous phase now has a strong green fluorescence. This phase may be separated and the quantity of highly fluorescent dye measured by spectrophotometry or spectrofluorimetry. The separated solution may require a fivefold or greater dilution with more extractant to bring its absorbence/emission characteristics into the optimum sensitivity range of the measuring instruments.

EXAMPLE 16

Five milliliters of marked colored gasoline prepared as in example ten are mixed with 95 milliliters of unmarked gasoline. This mixture is again subjected to the same extraction procedure with alkaline salt water as in Example 15. Even with this much diminished concentration of marker the aqueous extract is noticeably fluorescent and again the quantity of dye may be measured instrumentally, if desired, by comparison with a calibration standard.

EXAMPLE 17

A 50 milliliter sample of gasoline marked with 10 parts per million of dibutyrate ester of fluoroscein prepared in accordance with Example 6 has added to it 5 milliliters of a developer composition, which is a 10% solution of tetrabutyl ammonium hydroxide dissolved in diethylene glycol. The mixture is shaken for 1 to 2 minutes, when it acquires a dark fluorescent green appearance, clearly visible above the red background color of the gasoline. If only a qualitative detection of the marker in the gasoline is required, the developed, marked gasoline may be returned to the fuel source; thus avoiding a separate potentially hazardous waste disposal problem. If a quantitative determination of the marker is needed or desired, this can be accomplished by direct spectrophotometry or spectrofluorimetry, depending on the level of background interference from other components in the fuel. Otherwise, a 5 milliliter aliquot of a 10% solution of sodium chloride in distilled water may be added to the developed, marked fuel. When the mixture is shaken together for a short time the fluorescent marker will extract into a lower aqueous phase which may be separated and quantified as in Example 15.

EXAMPLE 18

A gasoline solution of 15 parts per million of 2,4,5,7 tetrabromo 3,6 diacetoxy fluorescein, synthesized as in example three, is prepared. The mixture is then subjected to the same development and extraction procedure detailed in Example 15. This time the separated aqueous phase is a bright red color with an orange fluorescence. The quantity of the eosine dye generated may also be quantified by spectrophotometry or spectrofluorimetry.

EXAMPLE 19

The procedure of example thirteen is repeated with the diacetyl ester of 4,5,6,7 tetrachloro 2,4,5,7 tetrabromofluoresceine. The hydrolized extracted marker contains the dianion of the dye historically known as Phloxine B. It has a bright cherry-red color with a dark green fluorescence.

EXAMPLE 20

100 milliliters of the gasoline solution containing 15 parts per million of the dibutyl ester of 4,5,6,7 tetrachlorofluorosceine, prepared as in example seven, has added to it 5 milliliters of an 8% solution of tetramethyl ammonium hydroxide in ethylene glycol mono n-propyl ether. The mixture is shaken and develops a dark green fluorescent appearance. The addition of 5 milliliters of a 10% aqueous sodium chloride solution will extract the hydrolyzed marker into a lower aqueous phase where it forms a brownish orange solution with a dark green fluorescence, quite different in appearance from the fluorescence of the unchlorinated dye instanced in Example 17 and easily distinguished from it.

EXAMPLE 21

100 milliliters of an essentially colorless toluene solution containing 30 parts per million of the distearoyl ester of succinfluorescein prepared as in example (14) is shaken for one minute with 20 mls of a mixture of 2 parts tetramethylammonium hydroxide, 48 parts ethylene glycol mono n-propyl ether and 50 parts water. The mixture is then allowed to separate. The lower aqueous phase has a very pale orange-yellow color which possesses a strong deep green fluorescence.

Applicant's invention has been described with reference to preferred embodiments. Numerous modifications to the described invention may be made without departing from the scope of the invention.

What is claimed is:

1. A composition comprising a petroleum product and a detectable level of a marker selected from the group consisting of:

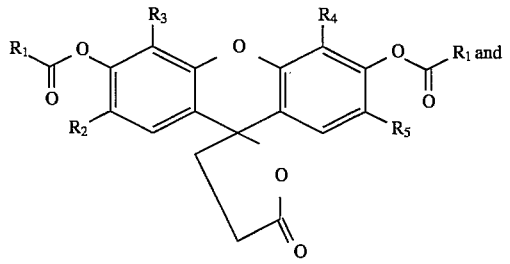

I.

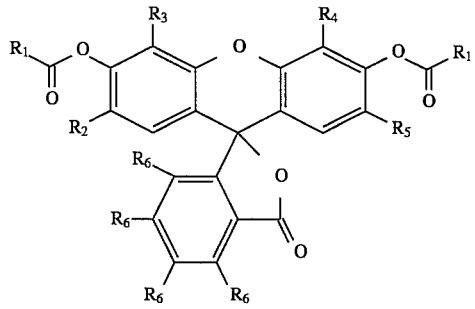

II.

wherein $R_1$ is $C_1$–$C_{18}$ alkyl group, or an aryl group, and $R_2$, $R_3$, $R_4$, and $R_5$ are hydrogen, chlorine, bromine or $C_1$–$C_{12}$ alkyl and $R_6$ is hydrogen, chlorine, or bromine; wherein said marker develops color or fluorescence upon contact with a developing reagent that converts said marker into a dianion.

2. A composition as recited in claim 1 wherein the marker is present in said petroleum product at a level of at least about 0.5 ppm.

3. A composition as recited in claim 1 wherein the marker is present at a level of at least about 5 ppm.

4. A composition as recited in claim 1 wherein the marker is present at a level of about 0.5 to about 100 ppm.

5. A composition as recited in claim 1 wherein $R_1$ is selected from the group consisting of $C_1$–$C_4$.

6. A composition as recited in claim 5 wherein $R_2$–$R_6$ are hydrogen.

7. A method of marking a petroleum product comprising adding to the petroleum product a detectable level of a marker selected from the group consisting of:

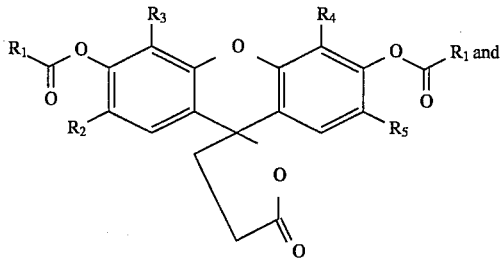

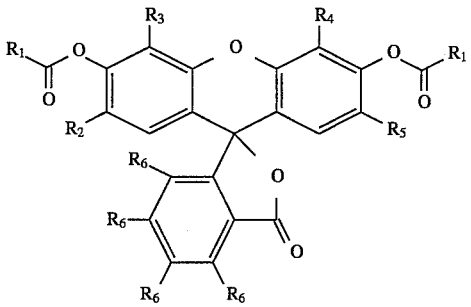

wherein $R_1$ is a $C_1$–$C_{18}$ alkyl group or an aryl group, and $R_2$, $R_3$, $R_4$ and $R_5$ are hydrogen, chlorine, bromine or $C_1$–$C_{12}$ alkyl group and $R_6$ is hydrogen, bromine or chlorine.

8. A method as recited in claim 7 wherein the marker is present at a level of at least about 0.5 ppm.

9. A method as recited in claim 7 wherein the marker is present at a level of at least about 5 ppm.

10. A method as recited in claim 7 wherein the marker is present at a level of about 0.5 to about 100 ppm.

11. A method as recited in claim 7 wherein $R_1$ is selected from the group consisting of $C_1$–$C_4$.

12. A method as recited in claim 11 wherein $R_2$–$R_5$ is H.

13. A method as recited in claim 11 wherein the marker is in liquid form when added to said petroleum product.

14. A method of identifying a petroleum product containing a marker comprising: a) obtaining a sample of petroleum product containing a detectable level of a marker selected from the group consisting of:

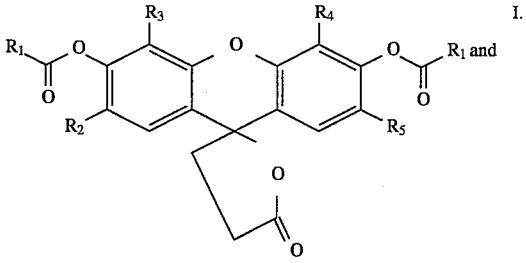

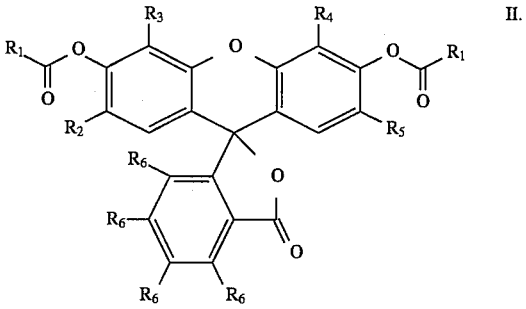

wherein $R_1$ is an alkyl group containing from one to eighteen carbon atoms, or an aryl group, and $R_2$, $R_3$, $R_4$, and $R_5$ are hydrogen, chlorine, bromine or $C_1$–$C_{12}$ alkyl group and $R_6$ is hydrogen, chlorine, bromine; and b) adding a developing reagent to said sample which develops color and fluorescence when contacted with said marker.

15. A method as recited in claim 14 wherein fluorescence is developed by base hydrolysis to produce a fluorescent dianion.

16. A method as recited in claim 15 wherein said developing reagent comprises a strong base.

17. A method as recited in claim 16 wherein said developing reagent has a pH of about 10 to about 14.

18. A method as recited in claim 17 wherein said base is selected from the group consisting of alkali metal hydroxides.

19. A method as recited in claim 18 wherein said base is a quaternary ammonium hydroxide.

20. A method as recited in claim 19 wherein said reagent has a pH of about 11 to about 13.

21. A method as recited in claim 19 wherein an extraction medium is added to said sample.

22. A method as recited in claim 21 wherein the extraction medium and the liquid petroleum product are combined in a ratio of about 1 to about 17 by volume.

23. A method as recited in claim 21 wherein said extraction medium is a mixture comprising water and a phase separation enhancer selected from the group consisting of aliphatic alcohols, aromatic alcohols, glycols, or glycol ethers.

24. A method as recited in claim 23 wherein said mixture further includes a quaternary ammonium hydroxide compound.

25. A method for identifying a petroleum product comprising:

a) obtaining a sample of petroleum product containing a detectable level of a marker selected from the group consisting of:

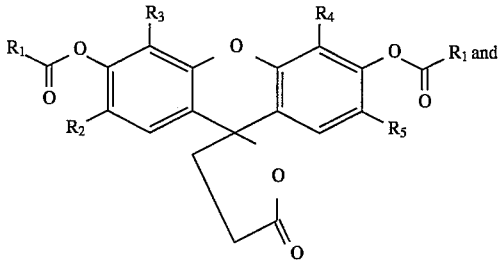

I.

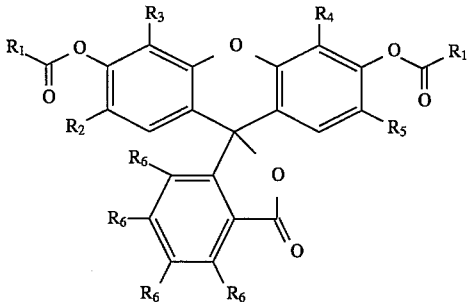

II.

b) adding a developing reagent to said marker, and c) extracting said marker into an extraction medium.

26. A fluid marker for liquid petroleum products comprising a) a marker selected from the group consisting of:

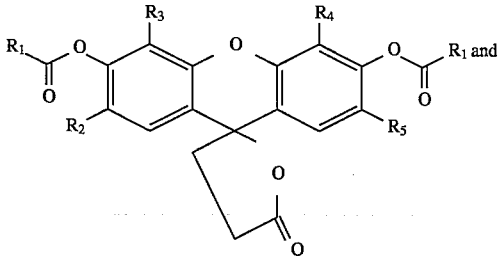

I.

-continued

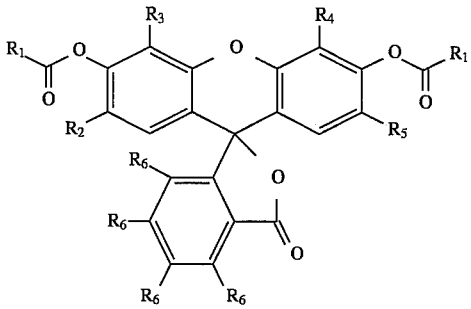

II.

wherein $R_1$ is an alkyl group containing from one to eighteen carbon atoms, or an aryl group, and $R_2$, $R_3$, $R_4$, $R_5$ are hydrogen, chlorine, bromine, or $C_1$–$C_{12}$ alkyl and $R_6$ is hydrogen, chlorine or bromine; and b) at least an equal weight of a solvent for said marker.

27. A composition as recited in claim 26 wherein said solvent is selected from the group consisting of aromatic hydrocarbons, aromatic alcohols and aprotic solvents.

28. A composition as recited in claim 27 wherein the weight ratio of said solvent to said marker is at least about 1:2.

29. A composition as recited in claim 26 wherein said composition comprises, by weight, about 0.5%–10% marker about; 70%–80% aromatic hydrocarbon or aromatic alcohol solvent and about 10%–30% aprotic solvent.

30. A composition as recited in claim 29 wherein said aprotic solvent is selected from the group consisting of 1 methylpyrrollidone, N,N dimethylformamide and formamide.

31. A composition as recited in claim 27 wherein $R_1$ is selected from the group consisting of $C_1$–$C_4$.

32. A composition as recited in claim 31 wherein $R_2$–$R_6$ are hydrogen.

* * * * *